US006435815B2

(12) United States Patent
Harvey et al.

(10) Patent No.: US 6,435,815 B2
(45) Date of Patent: Aug. 20, 2002

(54) AEROFOIL FOR AN AXIAL FLOW TURBO MACHINE

(75) Inventors: Neil W Harvey; Mark D Taylor, both of Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/748,865

(22) Filed: Mar. 12, 2001

(30) Foreign Application Priority Data

Jan. 22, 2000 (GB) ..... 0001399

(51) Int. Cl.[7] ..... F01D 5/14; F01D 9/04

(52) U.S. Cl. ..... 415/115; 415/914; 416/231 R; 416/231 B; 416/91

(58) Field of Search ..... 415/115, 116, 415/914; 416/90 R, 91, 231 R, 231 B, 223 A

(56) References Cited

U.S. PATENT DOCUMENTS

| | | | | |
|---|---|---|---|---|
| 2,135,887 A | * | 11/1938 | Fairey | 415/914 |
| 2,166,823 A | * | 7/1939 | Rosenlocher | 415/115 |
| 2,340,417 A | * | 2/1944 | Ellett | 244/130 |
| 2,637,487 A | * | 5/1953 | Sawyer | 415/115 |
| 4,146,352 A | * | 3/1979 | Yasugahira et al. | 415/144 |
| 4,687,416 A | | 8/1987 | Spranger | |
| 6,299,412 B1 | * | 10/2001 | Wood et al. | 416/223 A |
| 6,307,175 B1 | * | 10/2001 | Blochlinger et al. | 219/121.71 |

FOREIGN PATENT DOCUMENTS

| | | | |
|---|---|---|---|
| GB | 293656 SP | 7/1928 | |
| GB | 383821 SP | 9/1932 | |
| GB | 396716 SP | 8/1933 | |
| GB | 736835 SP | 9/1955 | |
| GB | 2 246 398 A | 1/1992 | |
| GB | 2 344 092 A | 5/2000 | |

* cited by examiner

*Primary Examiner*—Edward K. Look
*Assistant Examiner*—Richard A. Edgar
(74) *Attorney, Agent, or Firm*—W. Warren Taltavull; Manelli Denison & Selter PLLC

(57) ABSTRACT

An aerofoil (22,24), preferably of a high lift, highly loaded design, for an axial flow turbo machine (10). The aerofoil having a span, a leading edge (LE), a trailing edge (TE) and a cambered sectional profile comprising a pressure surface (30,72) and a suction surface (28,70) extending between the leading edge (LE) and trailing edge (TE). The aerofoil (22,24) having at least one aerofoil cross bleed passage (36,37,78,80) defined in the aerofoil (22,24) which extends from the pressure surface (30,72) through the aerofoil (22, 24) to the suction surface (28,70). The at least one passage (36,37,78,80) preferably disposed generally at a location on the suction surface (28,70) at which boundary layer separation from the suction surface (28,70) would normally occur. The passage (36,37,78,80) arranged to provide a bleed from the pressure surface (30,72) to the suction surface (28,70) with the passage (36,37,78,80) preferably angled towards the trailing edge (TE) at a shallow angle relative to the suction surface (28,70). The aerofoil (22,24) may be an aerofoil of a vane or blade of for example a gas turbine engine compressor or turbine.

27 Claims, 7 Drawing Sheets

AEROFOIL FOR AN AXIAL FLOW TURBO MACHINE

FIELD OF THE INVENTION

The present invention relates generally to aerofoils for an axial flow turbo machine and in particular to improvements to aerofoils for axial flow compressors and turbines of gas turbine engines.

BACKGROUND OF THE INVENTION

Axial flow turbo machines typically comprise a number of alternate stator and rotor rows in flow series. Both the rotor and stator rows comprise annular arrays of individual aerofoils. In the case of the stator rows the aerofoils comprise stator vanes and in the case of the rotor rows the aerofoils comprise blades mounted upon a rotor which rotates about a central axis. Typically in turbomachines the rotor and stator rows are arranged in pairs to form stages. For compressor stages the arrangement for each stage is typically rotor followed by stator, whilst for a turbine stage it is the opposite, namely stator followed by rotor. The individual stages, and aerofoils thereof, in use have an incremental effect on the flow of fluid through the stage giving rise to an overall resultant combined effect on the fluid flowing through the turbomachine. For a compressor the individual stages each incrementally increase the pressure of the flow through the stage. For a turbine the pressure decreases as energy is extracted from the flow through the stages to rotate and drive the turbine rotors.

In order to reduce the cost and weight of turbomachines it is desirable to reduce the number upstages and/or number of aerofoils in the rows of the stage, within a multi-stage axial flow turbomachine. In particular in gas turbine aeroengines, it is desirable to reduce the number upstages in the turbines and compressors. This requires the stage loading (i.e. effect each stage has on the flow therethrough) and thus the aerodynamic loading on the individual stages and aerofoils to be increased in order to maintain the same overall effect on the fluid flow through the turbomachine. Unfortunately as the aerodynamic loading increases the flow over the aerofoil surface tends to separate causing aerodynamic losses. This limits the stage loading that can be efficiently achieved.

In highly loaded turbine blades which operate at low Reynolds numbers, laminar boundary layer separation of the flow over the downstream rear portion of the suction surface cannot be avoided, and the blade is designed so that the separation and transition to turbulent boundary layer flow occurs before the trailing edge of the blade. Such high lift turbine aerofoil designs, the separation problems associated with them and a proposed means of addressing some of these problems are described in our UK patent application number GB9920564.3.

In highly loaded compressors, which often operate at high Reynolds numbers, fully turbulent boundary layer flows are present over the surfaces, and the blade is designed such that this turbulent layer does not separate from the aerofoil surface. If separation does occur then at the trailing edge there will be an open separation, in which the boundary layer does not reattach to the surface, resulting in high losses, increased flow deviation, reduced turning in the blade row and loss of pressure rise.

It is therefore desirable to provide an aerofoil in which the aerodynamic loading can be improved without significantly affecting the aerodynamic efficiency due to boundary layer separation and/or which offers improvements generally.

SUMMARY OF THE INVENTION

According to the present invention there is provided an exial flow turbo machine, the aerofoil having a span, a leading edge, a trailing edge and a cambered sectional profile comprising a pressure surface and a suction surface extending between the leading edge and trailing edge; characterised in that at least one aerofoil cross bleed passage is defined in the aerofoil, the passage extends from the pressure surface through the aerofoil to the suction surface.

Preferably the aerofoil is adapted in use to be highly loaded. The aerofoil may have a high lift profile.

Preferably an end of the at least one passage adjacent the suction surface is disposed generally at a location on the suction surface at which, in use, boundary layer separation from the suction surface would normally occur.

Preferably the at least one passage is arranged to provide, in use, a bleed from the pressure surface to the suction surface.

The at least one passage may be angled towards the trailing edge of the aerofoil. Preferably a portion of the passage adjacent to the suction surface is at a shallow angle relative to the suction surface. Furthermore the portion of the passage adjacent to the suction surface may be at an angle of less than 20° to the suction surface.

Preferably the at least one passage comprises a plurality of passages disposed along the span of the aerofoil. The plurality of passages may be disposed in a row substantially parallel to the aerofoil span. Furthermore the plurality of passages may be disposed in at least two rows substantially parallel the aerofoil span. The passages of a first row of the at least two rows may also be staggered relative to the passages of a second row of the at least two rows.

The at least one passage may be curved as the passage extends from the pressure surface through the aerofoil to the suction surface.

The cross sectional area of the passage may vary as the passage extends from the pressure surface through the aerofoil to the suction surface. Preferably there is a portion of the passage adjacent to the suction surface, the cross sectional area of this portion of the passage decreases towards an end of the passage adjacent to the suction surface. Alternatively there is a portion of the passage adjacent to the suction surface, the cross sectional area of this portion of the passage increases towards an end of the passage adjacent to the suction surface.

Preferably the at least one passage comprises a slot extending along at least part of the aerofoil span and extending through the aerofoil from the leading to the trailing edge.

The at least one passage may comprise a first portion adjacent to the suction surface and a second portion adjacent to the pressure surface, the first portion extending through the aerofoil at an angle to the second portion. The at least one passage may comprise a plurality of passages disposed along the span of the aerofoil and the second portion of the passages comprises a slot common to at least two of the passages and extending along at least part of the aerofoil span.

Preferably the aerofoil comprises part of a blade for a turbo machine. Alternatively the aerofoil may comprise part of a vane for a turbo machine.

The aerofoil may comprise a compressor aerofoil. The aerofoil profile may have a thickness between the pressure and suction surfaces, which increases from the leading edge to a maximum thickness at a position along a chord of the aerofoil closer to the trailing edge than to the leading edge. The maximum thickness of the aerofoil is preferably at a position from the leading edge substantially two thirds of the way along chord. An end of the at least one passage adjacent the suction surface may be disposed generally downstream of the position of maximum thickness of the aerofoil. Preferably an end of the at least one passage adjacent the suction surface is disposed generally downstream of the position of maximum curvature of the aerofoil.

The aerofoil may comprise a turbine aerofoil. An end of the at least one passage adjacent to the pressure surface may be disposed generally in a region of the pressure surface extending from the leading edge where, in use, boundary layer separation from the pressure surface would normally occur.

Preferably the at least one passage has a generally circular cross section. Alternatively the at least one passage may have a generally elliptical cross section.

The aerofoil may comprise part of a gas turbine engine.

BRIEF DESCRIPTION OF THE DRAWINGS

The present invention will now be described by way of example only with reference to the following figures in which.

DETAILED DESCRIPTION OF THE INVENTION

Figure 1:
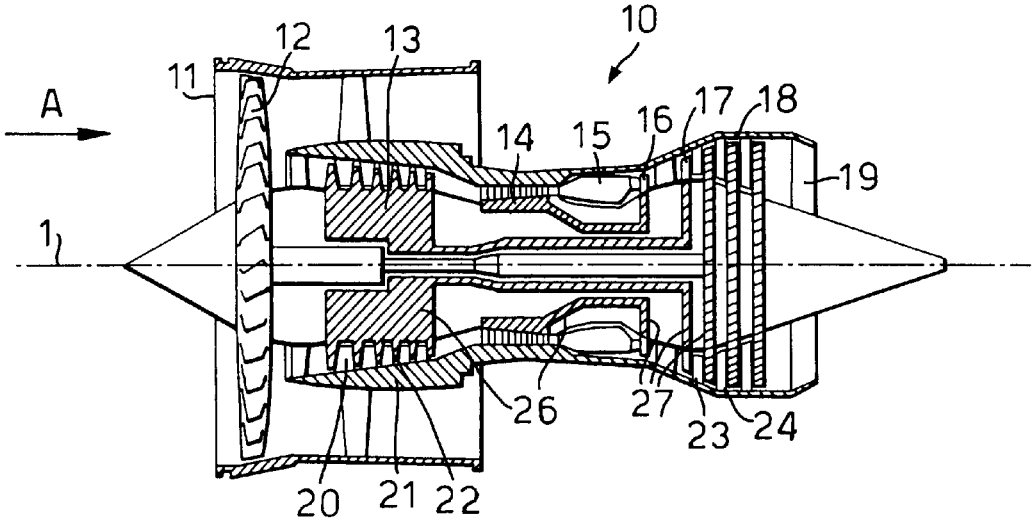
FIG. 1 shows a schematic representation of a gas turbine engine incorporating aerofoils according to the present invention.

The gas turbine engine 10 of FIG. 1 is one example of turbomachine in which the invention can be employed. It will be appreciated from the following however that the invention could equally be applied to other turbomachinery. The engine 10 is of generally conventional configuration, comprising in flow series an air intake 11, ducted fan 12, intermediate and high pressure compressors 13,14 respectively, combustion chambers 15, high intermediate and low pressure turbines 16,17,18 respectively and an exhaust nozzle 19 disposed about a central engine axis 1.

The intermediate and high pressure compressors 13,14 each comprise a number of stages each comprising a circumferential array of fixed stationary guide vanes 20, generally referred to as stator vanes, projecting radially inwards from an engine casing 21 into an annular flow passage through the compressors 13,14, and a following array of compressor blades 22 projecting radially outwards from rotary drums or discs 26 coupled to hubs 27 of the high and intermediate pressure turbines 16,17 respectively. This is shown more clearly in FIG. 2, which shows the high pressure compressor 14 of the gas turbine engine 10 shown in FIG. 1. The turbine sections 16,17,18 similarly have stages comprising an array of fixed guide vanes 23 projecting radially inwards from the casing 21 into an annular flow passage through the turbines 16,17,18, and a following array of turbine blades 24 projecting outwards from a rotary hub 27. The compressor drum or disc 26 and the blades 22 thereon and the turbine rotary hub 27 and turbine blades 24 thereon in operation rotate about the engine axis 1.

Each of the compressor and turbine blades 22,24 or vanes 20,23 comprise an aerofoil section 29, a sectoral platform 25 at the radially inner end of the aerofoil section 29, and a root portion (not shown) for fixing the blade 22,24 to the drum, disc 26 or hub 27, or the vane 20,23 to the casing 21. The platforms of the blades 22,24 abut along rectilinear faces (not shown) to form an essentially continuous inner end wall of the turbine 15,17,18 or compressor 13,14 annular flow passage which is divided by the blades 22,24 and vanes 20,23 into a series of sectoral passages.

Figure 2:
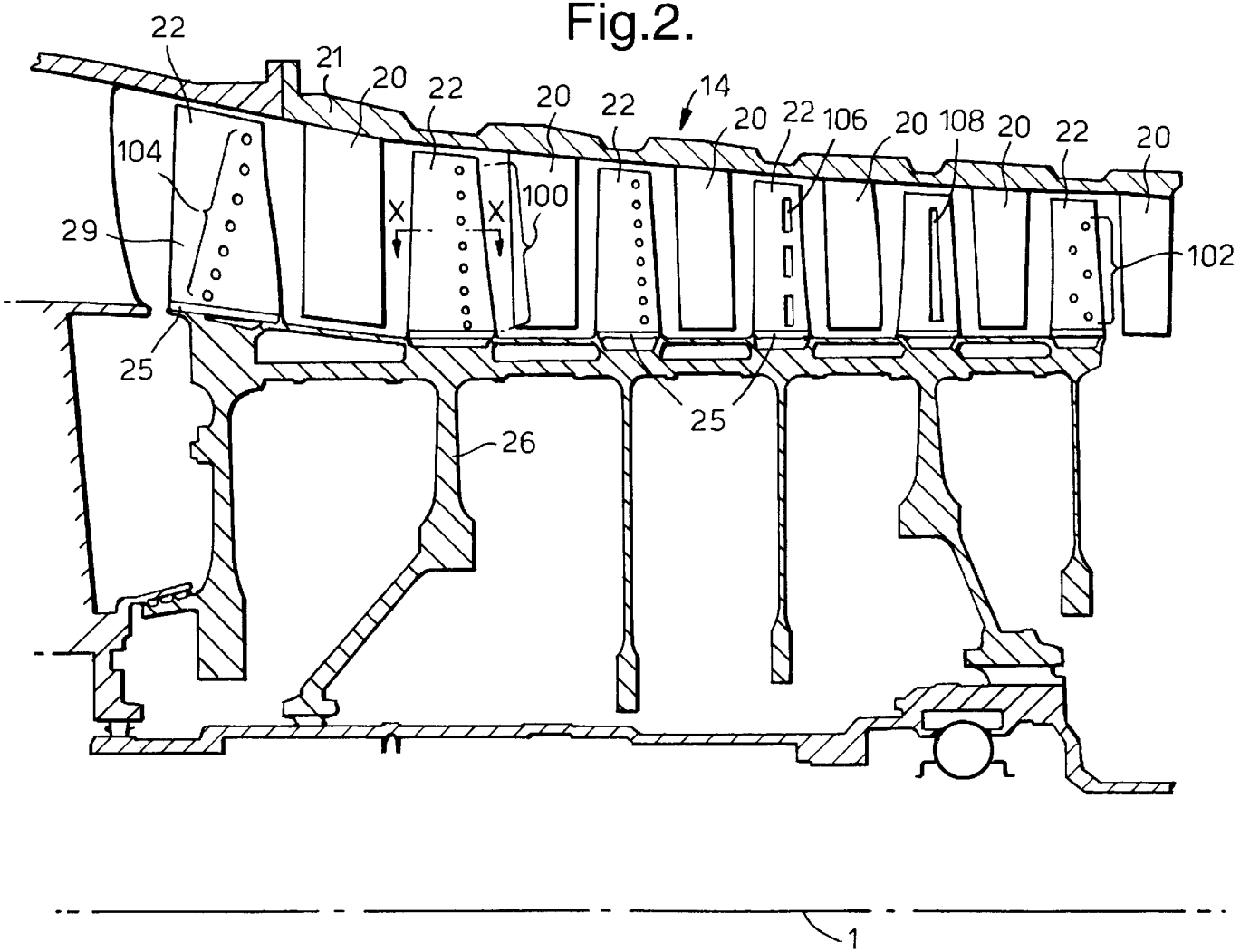
FIG. 2 shows a more detailed sectional view of a compressor section of the gas turbine engine shown in FIG. 1.
Figure 3:
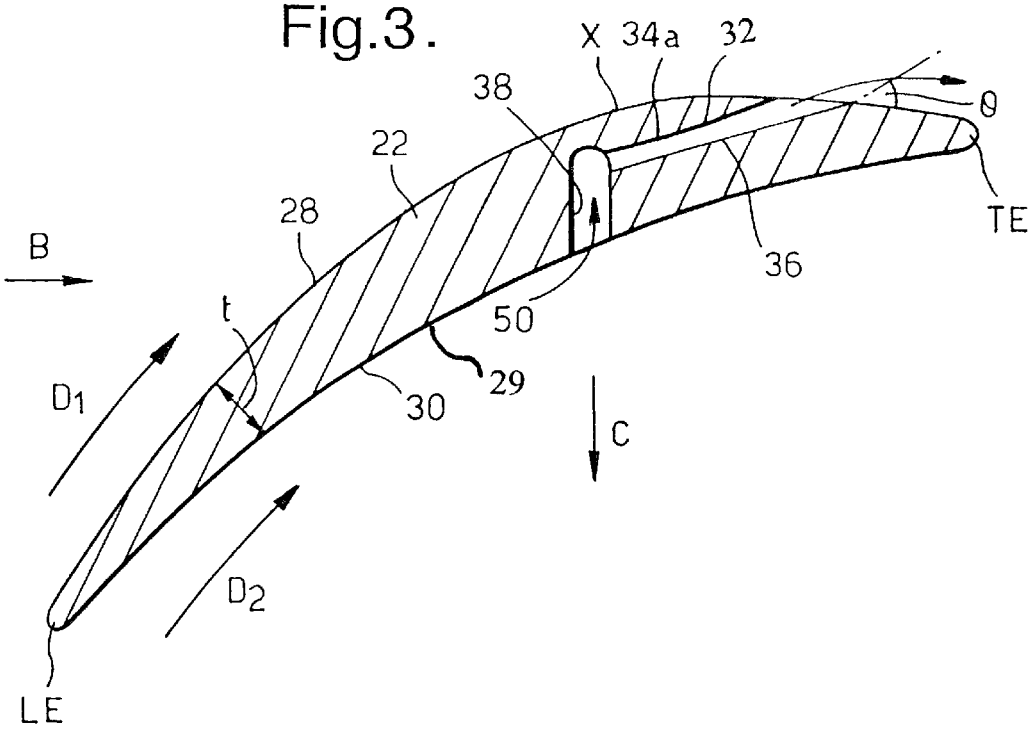
FIG. 3 shows a schematic cross section along line X—X through a compressor aerofoil of a compressor blade from the compressor shown in FIG. 2 showing a first embodiment of the invention.

A first embodiment of the invention is shown in FIG. 3, which is a cross section, on section X—X of FIG. 2, through a typical aerofoil section 29 of a compressor blade 22. Arrow B indicates the general direction, parallel to the engine axis 1, of gas flow through the compressor 14 relative to the aerofoil section 29, whilst arrows D1 and D2 indicate the resultant flow over the aerofoil section 29. As mentioned above the compressor blades 22 rotate about the engine axis 1 in operation and the direction of rotation relative to the aerofoil section 29 is shown by arrow C.

The blades 22 have a cambered aerofoil section 29 with a convex suction surface 28 and a concave pressure surface 30. The exact aerofoil profile is designed and determined, by conventional computational fluid dynamics (CFD) analysis techniques and computer modelling, to be very 'high lift' such that it sustains a large pressure loading as compared to conventional aerofoil designs. In other words the aerofoil section 29 is specifically designed to be highly loaded, at a loading level far above that at which suction side boundary layer separation is expected and can be avoided by conventional optimisation of the aerofoil profile. A comparison of the velocity distribution of this type of aerofoil profile with that of a conventional blade is shown in FIG. 10.

Figure 10:
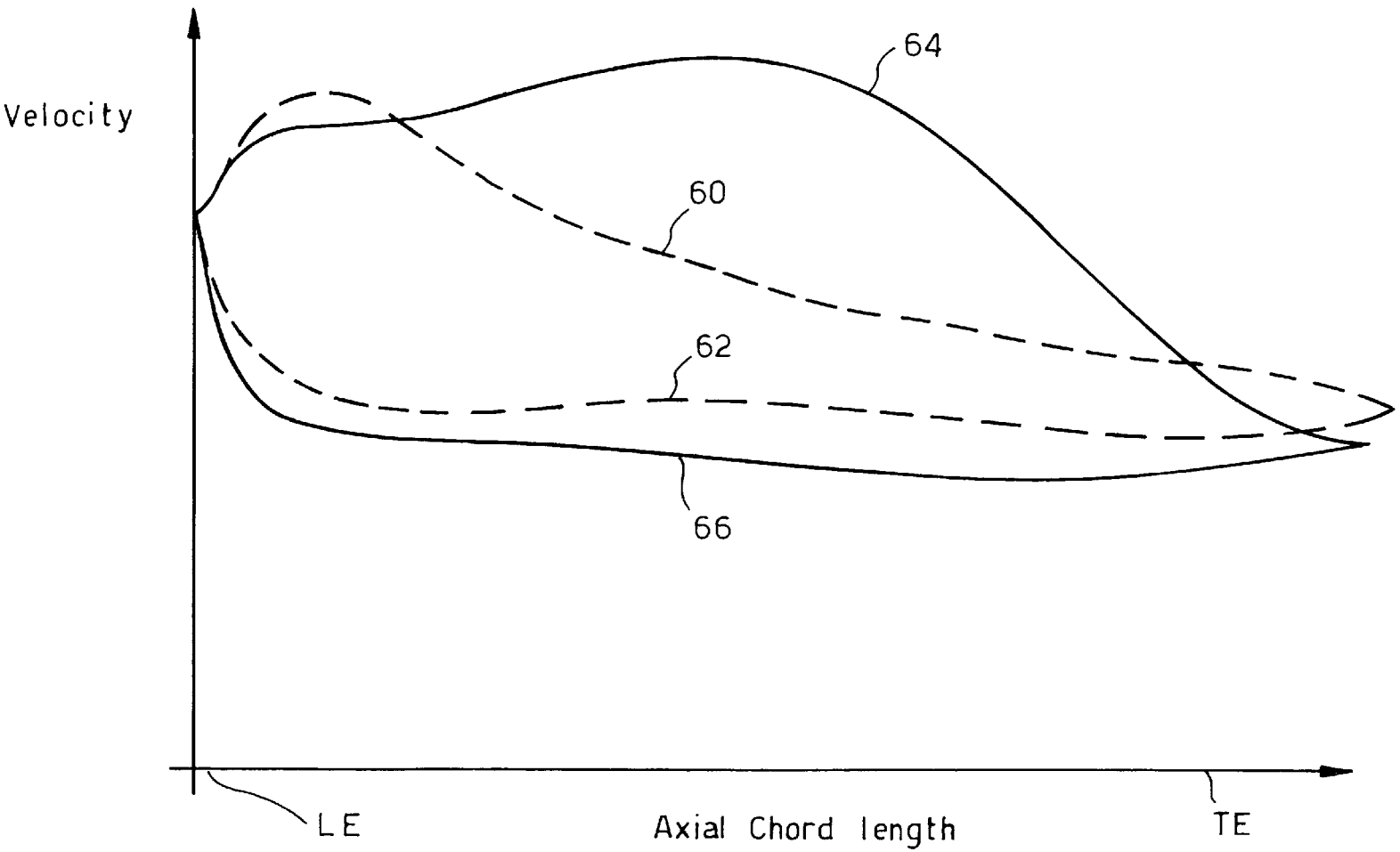
FIG. 10 is a graphical illustration of the change in velocity of the airflow over the compressor blade aerofoil.

In FIG. 10 the velocity of the airflow over the suction and pressure surfaces is plotted against the axial chord length of the blade. The dashed lines 60 and 62 show the surface mean velocities over the suction and pressure surfaces, respectively, for a typical conventional modern compressor blade aerofoil. By comparison the solid lines 64 and 66 show the surface mean velocities over the suction 28 and pressure 30 surfaces, respectively, of a typical high lift, highly loaded compressor blade 22 aerofoil profile of FIGS. 3–6. The pressure on either surface 28,30 of the aerofoil is inversely related to the velocity, and the lift generated by an aerofoil section 29 is therefore related to the area between the suction and pressure surface mean velocity lines 60,62 and 64,66 on the graph: i.e. for the conventional blade aerofoil the lift generated is related to the area between lines 60 and 62, whilst for the high lift blade aerofoil the lift generated is related to the area between lines 64 and 66 and is much greater than that of the conventional aerofoil section.

Figure 11:
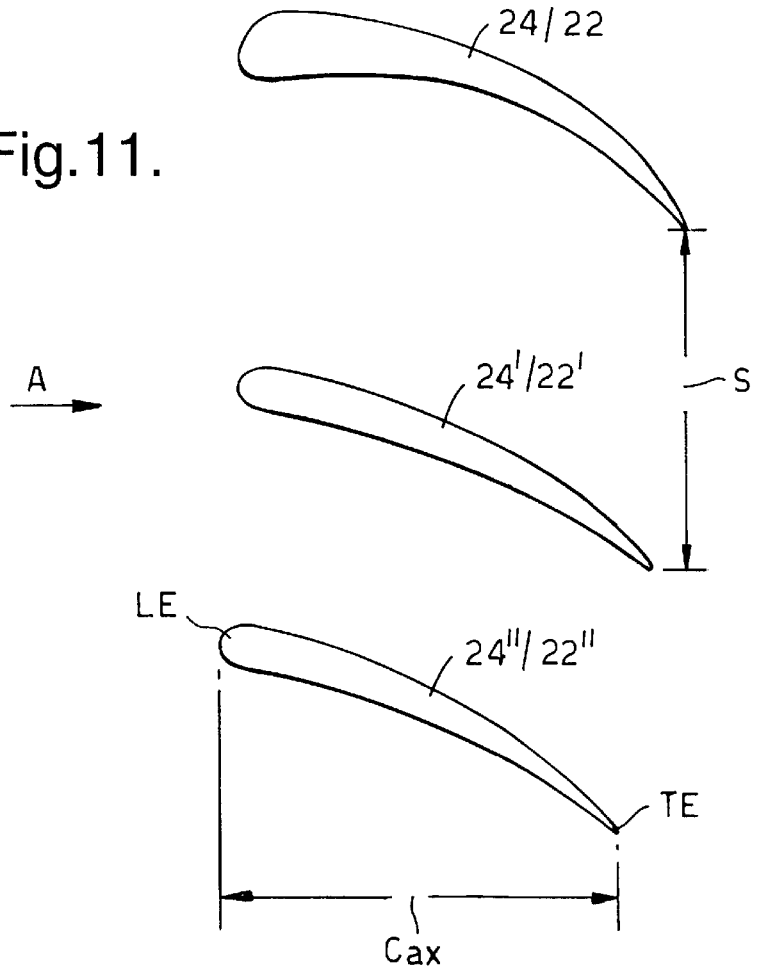
FIG. 11 is a schematic illustration showing how the pitch to chord ratio is defined for a row of either turbine or compressor aerofoils.

To achieve the high loading and high lift the aerofoil thickness t increases from the leading edge LE to a position closer to the trailing edge TE, and typically at a position about two thirds of the axial chord length from the leading edge LE. The pitch to chord ratio is also much greater than that of a conventional aerofoil design for the same inlet and outlet flow conditions. The pitch to chord ratio is defined as the ratio of the pitch S between the trailing edges of adjacent aerofoils in the array/row to the axial chord length $C_{ax}$ of the aerofoils as shown in FIG. 11. A high lift aerofoil design is typically characterised as one which has a higher pitch to chord ratio than conventional designs and in particular has a pitch to chord ratio over 20% greater than typical of conventional aerofoil profiles. In this embodiment the pitch chord ratio is about twice that of a conventional aerofoil design and the aerofoil generates about twice the lift.

Unfortunately with such a highly loaded, high lift compressor blade 22 aerofoil profiles, in operation, a turbulent boundary layer will develop adjacent to the suction surface 28. With such an aerofoil profile and loading the boundary layer would tend to separate at a nominal position 32 along the suction surface 28. Conventionally such boundary layer separation and the associated performance loss have prevented the use of such highly loaded high lift aerofoil profiles.

The blade 22 aerofoil section 29 incorporates a number of aerofoil cross bleed passages (generally indicated by reference 34) disposed along the radial length of the aerofoil section 29 of the blade 22. The passages 34 extend through the aerofoil section 29 from the pressure surface 30 to the suction surface 28 of the aerofoil section 29 as shown in FIGS. 3 to 6, which depict various embodiments of the invention. In operation, due to the pressure difference between the pressure on the pressure 30 and suction 28 surfaces, a gas flow is bled via the passages 34 from the pressure surface 30 to the suction surface 28 and a flow through the passages 34 as shown by arrows 50 and 42 is generated.

Referring to the particular embodiment shown in FIG. 3, each of the passages 34*a* comprise a hole 36 which is drilled or cast in and extends from the suction surface 28. The hole 36 and passage outlet in the suction surface 28 is and a very shallow angle Θ, typically less than 20°, to the suction surface at the outlet. Such a hole 36 at this shallow angle Θ, if extended through the aerofoil section 29, would not break through to the pressure surface 30 of the aerofoil section 29 due to the shape of the aerofoil section 29. Therefore a further hole 38 which extends from the pressure surface is drilled or cast in to interconnect with the first section of hole 36 and define a complete passage 34*a* through the aerofoil section 29. The further hole 38 may alternatively comprise a spanwise slot extending radially along the radial length and span of the blade 22. The slot may include reinforcing webs along its radial length and span. Such a slot could be common to a number of the passages 34*a* disposed along the length of the blade 22. The individual holes 36 disposed at radial positions along the length of the aerofoil section 29 connect with this slot to define the individual passages 34*a* along the radial length of the aerofoil section 29 of the blade 22.

The outlet of the passage 34*a* is at a location on the suction surface 28 as close as possible to the predicted nominal point 32 of boundary layer separation for the aerofoil section 29 profile. Preferably the outlet of the passages 34*a* is slightly downstream of, and towards the trailing edge TE side of, this point 32. With an aerofoil profile the airflow D1 over the suction surface 28 begins to diffuse downstream, relative to the general flow direction B, of the point of maximum curvature X of the profile generating the lift. Accordingly the boundary layer separation occurs downstream of this a point X along the aerofoil surface between the point of maximum curvature X along the profile, which is generally at the point of maximum thickness t of the aerofoil section 29, and the trailing edge TE of the aerofoil. In practice therefore the outlet of the passage 34*a* is at a point downstream (relative to the flow D1, D2 over the aerofoil) of the point of maximum thickness t of the aerofoil section 29.

In operation the flow bled from the pressure surface 30 which exits from the passage 34*a* outlet re-energises the boundary layer flow over the suction surface 28 downstream of passage 34*a* outlet. This has the effect of controlling and/or countering boundary layer separation from the suction surface 28. The losses associated with boundary layer separation are thereby minimised and/or reduced and the aerodynamic efficiency and performance of a highly loaded high lift aerofoil section 29 is improved. Consequently such a highly loaded high lift aerofoil section 29 can be efficiently used in a compressor 14 and the number of individual stages and/or the number of individual aerofoil/blades 22 required to produce the overall pressure increase in a compressor 14 can be reduced without compromising the overall aerodynamic performance of the compressor 14.

In order to re-energise the boundary layer it has been found that the passage 34 outlet must be at a shallow angle θ to the suction surface 28, typically less than 20°. It has been found that unless a shallow angle θ is used then the effect of the bleed flow exiting the passage 34 is to increase boundary layer separation rather than to re-energise the boundary layer and control or counter such separation.

Figure 4:
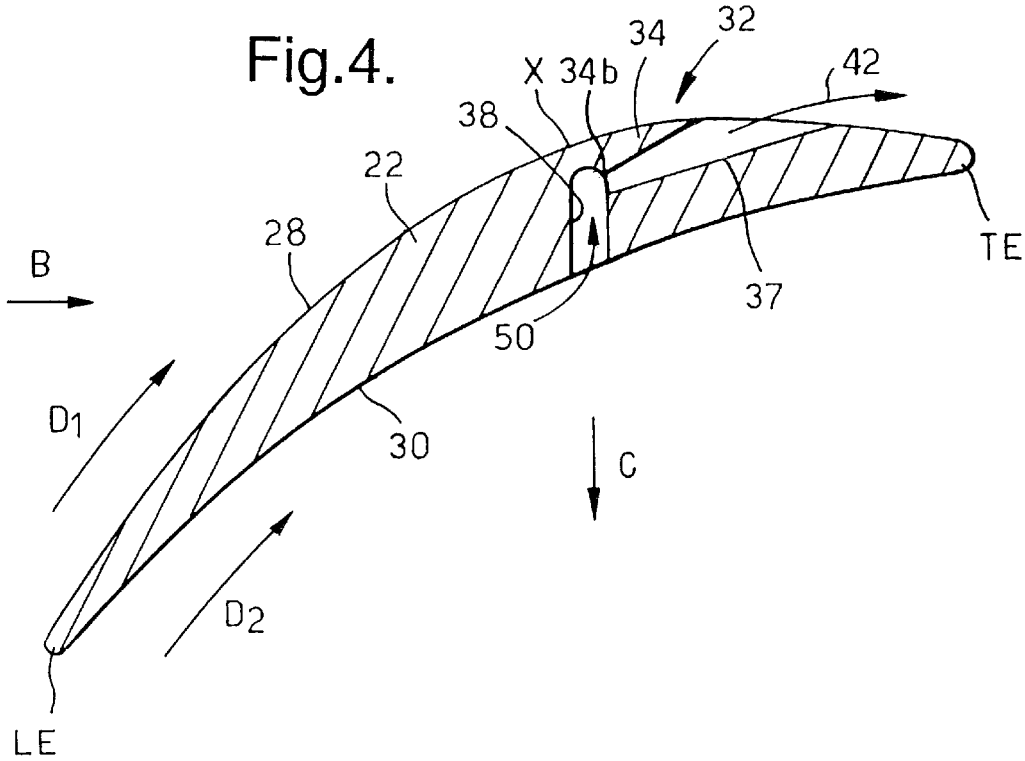
FIGS. 4 to 6 are schematic cross sections of compressor aerofoils similar to that of FIG. 3, but showing further embodiments of the invention.
Figure 5:
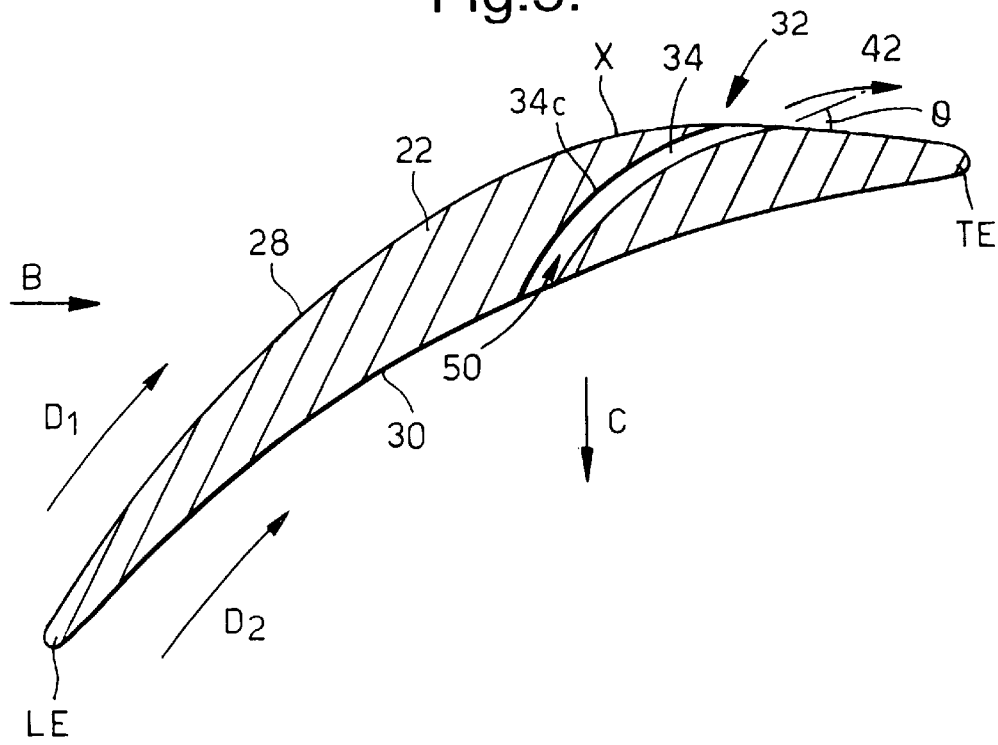
Figure 6:
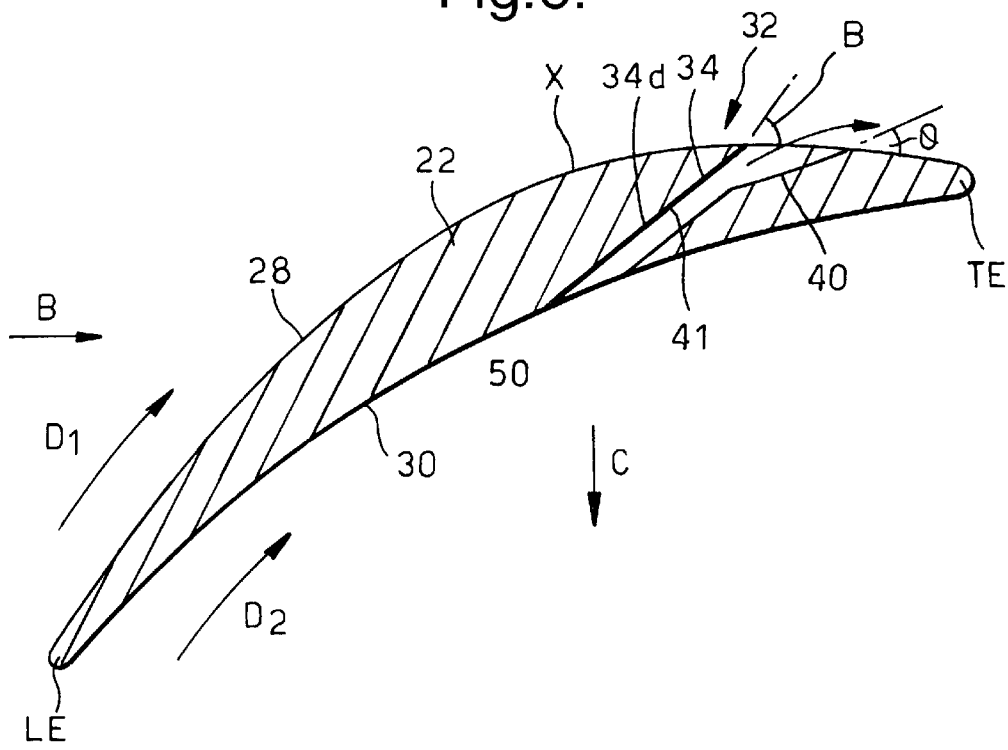

Further embodiments of the invention, as applied to compressor blades 22 and aerofoil sections 29, are shown in FIGS. 4 to 6. These embodiments are generally similar to that shown in FIG. 3. Consequently only the differences will be described and like reference numerals have been used to refer to like features.

In the embodiment shown in FIG. 4 the passage 34*b* through the aerofoil section 29 comprises a hole 37 extending from and drilled or cast in the suction surface 28. This hole 37 has a varying cross sectional flow area. As shown the hole 37 is fan shaped and diverges towards the outlet in the suction surface 28. Such a divergent hole 37 diffuses and slows the flow 42 exiting the through the passage 34*b* outlet. Alternatively a tapering converging hole (not shown) could be used, in which the cross sectional flow area decreases towards the outlet in the suction surface 28. A tapering converging hole would accelerate the gas flow exiting the hole and passage 34 on the suction surface 28. Varying the velocity of the flow exiting the passage 34 by varying the cross sectional flow area allows the boundary layer re-energising effect to be optimised for the particular aerofoil section profile 29 and specific requirements of the particular application. As with the detailed design of the aerofoil section 29 profile this is determined using CFD and computer modelling of the flows.

As shown in FIG. 5 the passages 34*c* through the aerofoil section 29 could be curved so that they bend over towards the trailing edge TE and pressure surface 30 to maintain a shallow angle θ at the outlet of the passage 34*c* on the suction surface 28. With such a curved passage 34*c* the additional hole or slot 38 in the pressure surface 30 is not required, although the manufacture of the passage 34*c* may be more problematic.

An alternative solution to ensuring that the passage 34 outlet is at a shallow angle θ relative the suction surface 28 is shown in FIG. 6. In this case the holes 34*d* have a compound angle so that they are 'laid back' at the passage 34*d* outlet. A main part of the passage 41 is at a relatively steep angle β to the suction surface 28 so that an additional hole is not required, whilst at the passage 34*d* outlet the downstream side 40 of the passage 34*d* is at a shallow angle θ relative to the suction surface 28. Due to the general downstream of the flow D1, D2 the flow though the passage 34*d* will tend to flow along the downstream side of the passage 34*d*. Consequently the outlet flow provided by the passage 34*d* is at the relatively shallow angle θ to the suction surface 28 as required.

The passages 34 are disposed along the radial length of the aerofoil section 29 of the blades 22. Referring to FIG. 2 the passages 34 may be disposed radially in a row extending radially along the length of the aerofoil section 29 of the blade 22 as indicted at 100. Alternatively instead of a single row of passages 34 two or more axially staggered rows of passages 34 may be used as indicated at 102. The individual passages 34 are staggered about the boundary layer separation point 32. By staggering the passages 34 the stress concentration caused by the passages 34 through the aerofoil section 29 may be reduced. The passages 34 may also be disposed along the radial length of the blade 22 along a non radial line or curve as indicated at 104 or disposed over the radial length of the blade 22 at varying axial positions (not shown). In particular if the sectional profile of the aerofoil section 29 of the blade 22, and/or the flow over the aerofoil section 29, varies along the radial length and span of the blade 22 then the position of the passages 34 along the length will vary accordingly so that the outlet flow 42 from the passages 34 provides optimal re-energisation of the boundary layer flow over the suction surface 28 of the aerofoil section 29 at each radial position along the blade 22. It will be appreciated by those skilled in the art that the exact positioning of the passages 34 at the various radial positions along the radial length of the blade 22 can be determined by the CFD analysis of the particular detailed aerofoil section 29 profile and turbomachine flows. It will also be recognised that different arrangements of the passages 34 shown in FIG. 2 would not normally be used in the same compressor 14 and that the different arrangements have been shown together in FIG. 2 for illustrative purposes only.

The cross section of the passages 34 is typically generally circular. However depending on the particular flow characteristics and the stress concentrations present in the aerofoil section 29 or blade 22 the passage's 34 cross section may be elliptical, oval or of any other shape. Furthermore the passages 34 disposed along the length and span of the aerofoil section 29 may be combined into one or more radial slots through the aerofoil section 29 as indicated at 106 and 108.

The use of aerofoil cross bleed passages 34 through the aerofoil section 29 can also be applied in similar ways to highly loaded turbine blades 24 of a gas turbine engine 10. The applicability of the invention to turbine blades 24 is however limited to some extent by the gas temperature and the material properties of the blade. If the gas temperature is too high and/or the temperature properties of blade material are not sufficient then it will not be possible to bleed a flow through the aerofoil cross bleed passages since such a flow of high temperature gas would damage the blade 24. In practice therefore for turbines the invention is generally applicable to uncooled turbine blades and vanes for example in the low pressure turbine 18, which operate towards the downstream end of the engine 10, rather than film cooled blades which operate at higher temperatures. Furthermore with film cooled blades in which a flow of cooling air is provided over the aerofoil surfaces to cool the blades/vanes, the aerodynamic flows and separation of boundary layers is very different with the film cooling altering the boundary layer and the invention is less applicable.

Figure 7:
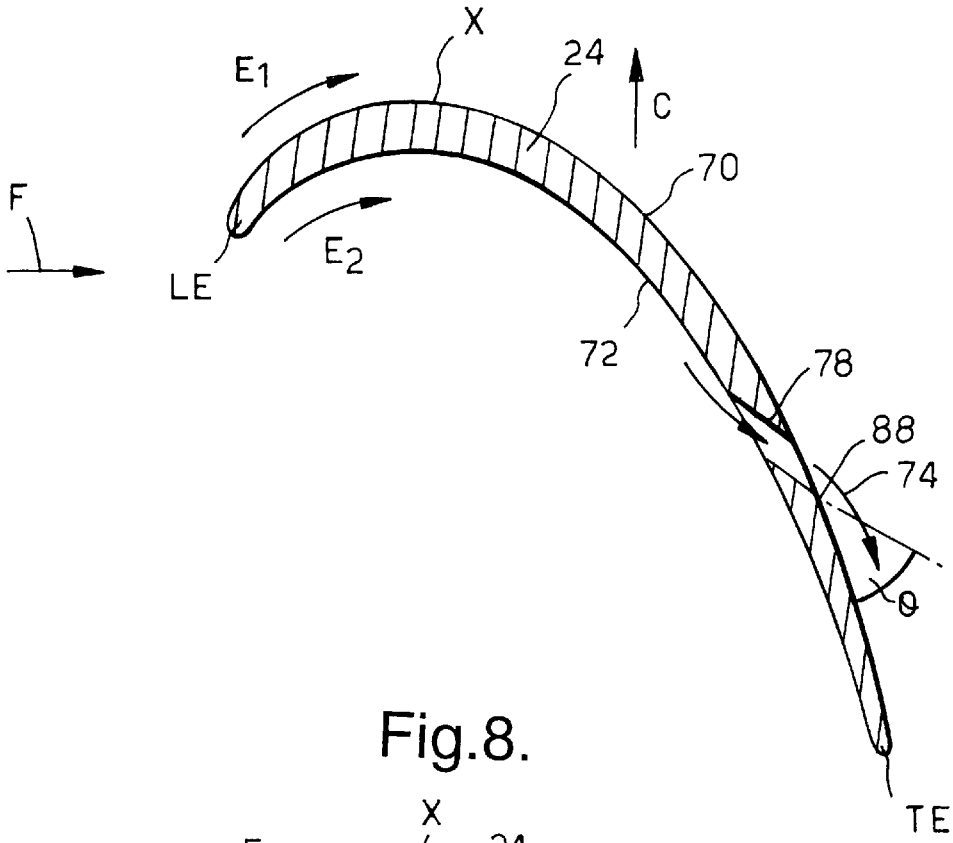
FIGS. 7, 8, and 9 are schematic cross sections similar to that of FIG. 3 but through turbine aerofoils of a turbine blade of a gas turbine engine showing two further embodiments of the invention.

FIG. 7 shows a cross section, through the aerofoil section 29 of a highly loaded turbine blade 24 from the low pressure turbine 18. The flow direction, which is generally parallel to the engine axis 1, through the turbine is shown by arrow F whilst the flow over the suction surface 70 and pressure surface 72 is shown by arrows E1 and E2. The direction of rotation of the turbine rotor and so of the turbine blade is shown by arrow C. In the case of a turbine 18 however it is the flows E1, E2 over the turbine aerofoil section 29 which generate a pressure difference between the pressure 72 and suction 70 surfaces that provide a force to rotate the turbine 18.

Modern turbine aerofoil profiles such as shown in FIG. 7, operate at low Reynolds numbers, as compared to compressor aerofoils, and a laminar boundary layer flow E1 over the suction surface 70 of the aerofoil section 29 will tend to separate from the suction surface 70 at a point 88 towards the trailing edge TE and rear of the suction surface 70. As shown in FIG. 7, according to the invention, aerofoil cross bleed passages 78 extending through the aerofoil section 29 from the pressure surface 72 to the suction surface 70 are machined or cast in the turbine aerofoil section 29. A number of passages 78 are disposed along the radial length of the aerofoil section 29 of the blade 24 as with the aerofoil cross bleed passages 34 described in relation to compressor aerofoils. As also with the compressor aerofoil cross bleed passages 34 the outlet of these passages 78 is at a shallow angle θ, typically less than 20°, to the suction surface 70 at the passage 78 outlet. In operation, there is a bleed flow from the pressure surface 72 to the suction surface 70 through the passages 78. Due to the angle of the passage 78 this flow exits the passage 78 at a shallow angle θ relative to the suction surface 70. This flow exiting the passage 78 controls the separation of the boundary layer by promoting rapid transition of the laminar boundary layer to a turbulent boundary layer which will flow over the remaining downstream portion of the suction surface 70 is less likely to separate from the suction surface 70. As such much higher levels of diffusion can be sustained over the suction surface 70 of the turbine aerofoil section 29 as compared to conventional turbine blades without such cross bleed passages 78. Since higher diffusion can be sustained by the turbine aerofoil section 29 larger pitch to chord ratios, and so higher loading of the turbine aerofoil section 29, can be achieved without the losses associated with boundary layer separation. Consequently for a given duty the number of turbine blades 24 or vanes 23 can be reduced.

Figure 8:
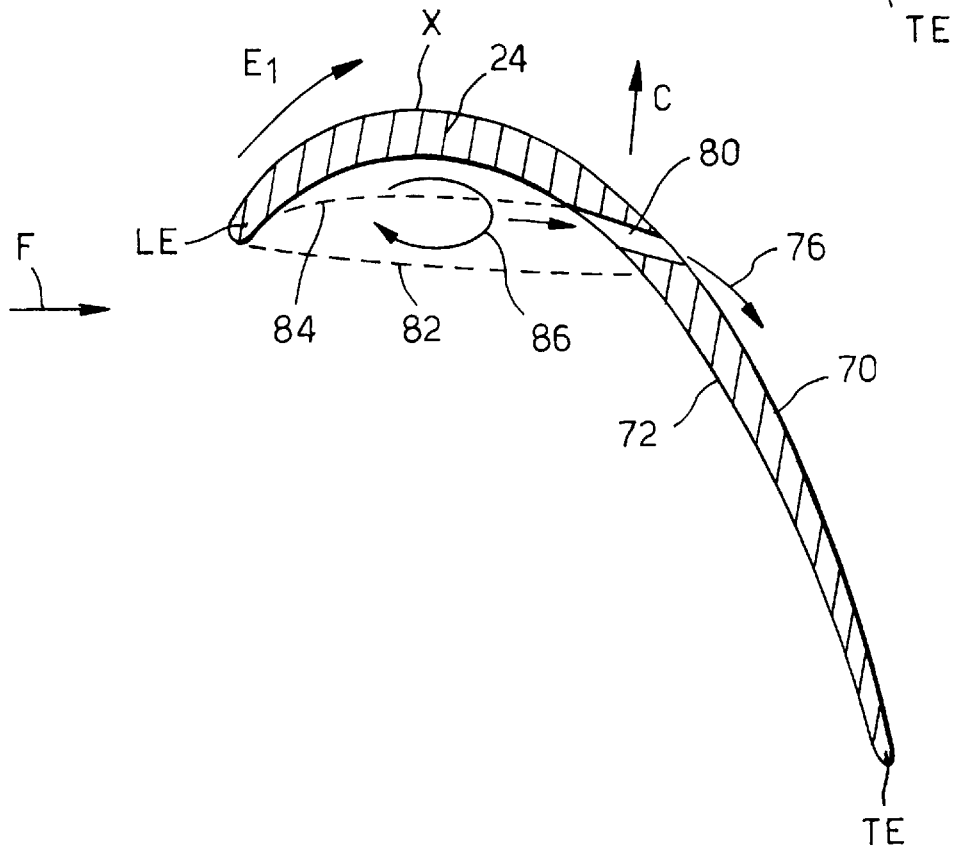

Alternatively with a highly loaded turbine aerofoil section 29, aerofoil cross bleed passages 80 can be positioned further upstream along the suction surface 70, further towards the leading edge LE of the aerofoil section 29 as shown in FIG. 8 in order to address a further aerodynamic problem with modern turbine aerofoil sections 29 and in particular with the turbine aerofoil sections of the downstream turbine stages, for example the low pressure turbine 18 stages. With modern very thin, low Reynolds number turbine aerofoils, typical of the low pressure turbine 18, the boundary layer will separate immediately downstream of the leading edge LE. This creates a region of separated, recirculating flow on the pressure side of the aerofoil which is naturally contained by the 'hollow' defined by the concave surface on the pressure side. This separated flow region is often referred to as a separation bubble 86. Such large separation bubbles 86 occur when there is a large diffusion on the upstream part of the pressure surface 72 which is unavoidable if very thin aerofoil sections 29, as is typical of modern gas turbine blading in order to reduce weight, are used. The presence of a large separation bubble 86 is undesirable since it may give rise to losses due to unsteady eddy shedding of the bubble 86, or it may impede the gas flow through the turbine 18. In addition a large separation bubble 86 may generate secondary flows within the turbine 18 which in themselves reduce the turbine 18 efficiency.

The aerofoil cross bleed passages 80 bleed flow from the region where a separation bubble 86 is likely to be generated. This reduces the size of the separation bubble 86 actually generated and so reduces the effect of the separation bubble 86 on the turbine aerofoil section 29 performance. The effect of the cross bleed passages 80 is shown in FIG. 8, where dashed line 82 denotes the extent of the separation bubble 86 for the aerofoil profile without the cross bleed passage 80, whilst line 84 denotes the extent of the separation bubble with the cross bleed passages 80.

Whilst by placing the aerofoil cross bleed passages 80 at this forward upstream position the losses associated with the separation bubble 86 are reduced, it must be recognised that the passage 80 outlet flow 76 will generate early transition of the laminar boundary layer flow over the suction surface 70 to a turbulent boundary layer flow. Since such transition is upstream of the position 88 where laminar boundary layer separation and transition occurs an aerodynamic loss is generated. This has to be balanced against the performance benefit associated with reducing the bubble 86 size.

It should be noted though that cooled blades and vanes typical of the upstream turbines, for example, high-pressure turbine 16 stages, have a relatively thick profile in order to accommodate cooling passages. With such thick blades the 'hollow' in the pressure surface is less pronounced and the problems with the separation bubble are reduced. Consequently the advantages of this embodiment of the invention are reduced with cooled turbine blades and vanes. This embodiment of the invention is therefore generally most applicable to uncooled turbine blades and vanes typically associated with the downstream turbines stages and low pressure turbine 18.

Figure 9:
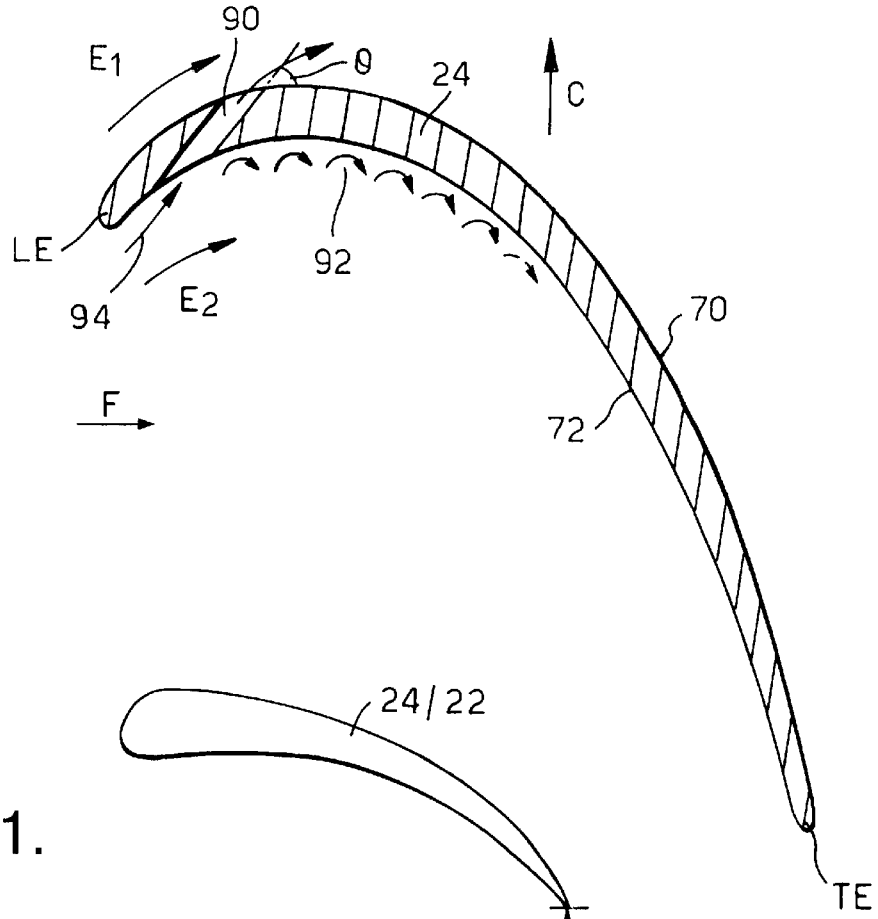

In the limit, aerofoil cross bleed passages 90 can be positioned near the leading edge LE of the turbine blade 24 aerofoil section as shown in FIG. 9. In this embodiment aerofoil cross bleed passages 90 are located towards the leading edge LE of the aerofoil. The flow 94 of a portion of the flow E2 over the pressure surface 72 generates streamwise vortices 92 downstream of the inlet to the passages 90. These vortices 92 promote transition of the boundary layer flow along the pressure surface 72 from laminar flow to turbulent flow. The resulting turbulent boundary layer flow downstream of the passage 90 inlet, along the pressure surface can sustain the larger diffusion on the early region of the pressure surface 72 of a high lift turbine aerofoil profile and thus boundary layer separation over the pressure surface 72 and so formation of the separation bubble 86 is reduced. It will be appreciated so that as with the embodiment shown in FIG. 8, the output flow to 96 from the passage 90 onto the suction surface 70 will cause early transition of the boundary layer or flow over the suction surface 70 which will increase the aerodynamic loss over the suction surface 70. In water for the aerofoil cross bleed passages 90 to provide an overall performance benefit this loss will have to be balanced against the performance benefit associated with eliminating the separation bubble from the pressure surface 72 and this will depend upon the particular application and detailed characteristics of the aerofoil profile and flows through the turbine as determined by CFD.

Although the invention has been described in relation to compressor and turbine blades 22,24 it will be appreciated by those skilled in the art that it can be applied to the aerofoil sections of compressor and turbine stator vanes 20,23.

It will also be appreciated that although the invention has been described with reference to two particular aerofoil section 29 profiles it can be applied to other design of highly loaded aerofoil section 29 profiles in which separation of the boundary layer may be a problem. The invention improves the aerodynamic performance of the aerofoil section 29 and turbomachine stage and/or allows the practical efficient use of such highly loaded high lift aerofoil profiles. Furthermore although the invention is particularly applicable to high lift highly loaded turbo machines and aerofoil section 29 profiles it may also be beneficial to a more conventionally loaded aerofoil profiles.

We claim:

1. An aerofoil for an axial flow turbo machine, the aerofoil having a span, a leading edge, a trailing edge and a cambered sectional profile comprising a pressure surface and a suction surface extending between the leading edge and trailing edge, at least one aerofoil cross bleed passage being defined in the aerofoil, the passage extending from the pressure surface through the aerofoil to the suction surface, said one passage having an end, said end of said one passage adjacent the suction surface being disposed generally at a location on the suction surface at which, in use, boundary layer separation from the suction surface would normally occur, said portion of the passage adjacent to the suction surface being at an angle of less than 20 degrees to the suction surface.

2. An aerofoil as claimed in claim 1 in which the aerofoil is adapted in use to be highly loaded.

3. An aerofoil as claimed in claim 1 in which the aerofoil has a high lift profile.

4. An aerofoil as claimed in claim 1 in which the at least one passage is angled towards the trailing edge of the aerofoil.

5. An aerofoil as claimed in claim 1 in which the at least one passage comprises a plurality of passages disposed along the span of the aerofoil.

6. An aerofoil as claimed in claim 5 in which the plurality of passages are disposed in a row substantially parallel to the aerofoil span.

7. An aerofoil as claimed in claim 5 in which the plurality of passages are disposed in at least two rows substantially parallel the aerofoil span.

8. An aerofoil as claimed in claim 7 in which the passages of a first row of the at least two rows are staggered relative to the passages of a second row of the at least two rows.

9. An aerofoil as claimed in claim 1 in which the at least one passage is curved as the passage extends from the pressure surface through the aerofoil to the suction surface.

10. An aerofoil as claimed in claim 1 in which the cross sectional area of the passage varies as the passage extends from the pressure surface through the aerofoil to the suction surface.

11. An aerofoil as claimed in claim 10 in which there is a portion of the passage adjacent to the suction surface, the cross sectional area of which portion of the passage decreasing towards an end of the passage adjacent to the suction surface.

12. An aerofoil as claimed in claim 10 in which there is a portion of the passage adjacent to the suction surface, the cross sectional area of which portion of the passage increasing towards an end of the passage adjacent to the suction surface.

13. An aerofoil as claimed in claim 1 in which the at least one passage comprises a slot extending along at least part of the aerofoil span and extending through the aerofoil from the leading to the trailing edge.

14. An aerofoil as claimed in claim 1 in which the at least one passage comprises a first portion adjacent to the suction surface and a second portion adjacent to the pressure surface, the first portion extending through the aerofoil at an angle to the second portion.

15. An aerofoil as claimed in claim 1 in which the aerofoil comprises part of a blade for a turbo machine.

16. An aerofoil as claimed in claim 1 in which the aerofoil comprises part of a vane for a turbo machine.

17. An aerofoil as claimed in claim 1 in which the aerofoil comprises a compressor aerofoil.

18. An aerofoil as claimed in claim 1 in which the aerofoil profile has a thickness between the pressure and suction surfaces which increases from the leading edge to a maximum thickness at a position along a chord of the aerofoil closer to the trailing edge than to the leading edge.

19. An aerofoil as claimed in claim 18 in which the maximum thickness of the aerofoil is at a position from the leading edge substantially two thirds of the way along the chord.

20. An aerofoil as claimed in claim 18 in which an end of the at least one passage adjacent the suction surface is disposed generally downstream of the position of maximum thickness of the aerofoil.

21. An aerofoil as claimed in claim 18 in which an end of the at least one passage adjacent the suction surface is disposed generally downstream of the position of maximum curvature of the aerofoil.

22. An aerofoil as claimed in claim 1 in which the aerofoil comprises a turbine aerofoil.

23. An aerofoil as claimed in claim 1 in which an end of the at least one passage adjacent to the pressure surface is disposed generally in a region of the pressure surface extending from the leading edge where, in use, boundary layer separation from the pressure surface would normally occur.

24. An aerofoil as claimed in claim 1 in which the at least one passage has a generally circular cross section.

25. An aerofoil as claimed in claim 1 in which the at least one passage has a generally elliptical cross section.

26. An aerofoil as claimed in claim 1, wherein the axial flow turbo machine is a gas turbine engine.

27. An aerofoil for an axial flow turbo machine, the aerofoil having a span, a leading edge, a trailing edge and a cambered sectional profile comprising a pressure surface and a suction surface extending between the leading edge and trailing edge, at least one aerofoil cross bleed passage being defined in the aerofoil, the passage extending from the pressure surface through the aerofoil to the suction surface, said at least one passage comprising a first portion adjacent to the suction surface and a second portion adjacent to the pressure surface, the first portion extending through the aerofoil at an angle to the second portion, with a plurality of passages being provided disposed along the span of the aerofoil with the second portion of the passages comprising a slot common to at least two of the passages and extending along at least part of the aerofoil span.

* * * * *